US005973454A

United States Patent [19]

Ooyama et al.

[11] Patent Number: 5,973,454

[45] Date of Patent: Oct. 26, 1999

[54] SHORT ARC TYPE METAL HALIDE LAMP WITH ENCAPSULATED RARE EARTH METAL HALIDES TO INCREASE COLOR REPRODUCIBILITY

[75] Inventors: Masachika Ooyama; Mitsuo Horikoshi, both of Himeji, Japan

[73] Assignee: Ushiodenki Kabushiki Kaisha, Tokyo, Japan

[21] Appl. No.: 08/919,509

[22] Filed: Aug. 28, 1997

[30] Foreign Application Priority Data

Aug. 28, 1996 [JP] Japan ..... 8-244039

[51] Int. Cl.[6] ..... H01J 17/20

[52] U.S. Cl. ..... 313/639; 313/640; 313/641; 313/642; 313/546; 313/638; 313/643

[58] Field of Search ..... 313/640, 641, 313/642, 546

[56] References Cited

U.S. PATENT DOCUMENTS

| | | | |
|---|---|---|---|
| 3,110,556 | 11/1963 | Peppard et al. | 313/640 |
| 3,761,758 | 9/1973 | Bamberg et al. | 313/229 |
| 3,852,630 | 12/1974 | Wesselink et al. | 313/228 |
| 5,028,843 | 7/1991 | Narita | 313/641 |
| 5,220,244 | 6/1993 | Maseki et al. | 313/620 |
| 5,451,838 | 9/1995 | Kawai | 313/638 |
| 5,698,948 | 12/1997 | Caruso | 313/637 |
| 5,773,932 | 6/1998 | Ooyama et al. | 313/639 |

*Primary Examiner*—Sandra O'Shea
*Assistant Examiner*—Ronald E. DelGizzi
*Attorney, Agent, or Firm*—Sixbey, Friedman, Leedom & Ferguson; David S. Safran

[57] ABSTRACT

A metal halide lamp in which the radiant efficiency is not adversely affected, in which outstanding color reproducibility is obtained, and which is suitable for a light source of an OHP or a direct projector is achieved, according to the invention, by the fact that, within an arc tube provided with a pair of electrodes, together with mercury and a starting rare gas, halides of dysprosium (Dy), yttrium (Y) and cesium (Cs) are encapsulated with the molar ratio of the encapsulated metals Dy to Y is being fixed in the range of $0.3 \leqq Dy/Y \leqq 1.0$. In this way the green portion to which there is a sensitive visual reaction is reduced, the blue portion increased, and thus the color reproducibility is increased.

5 Claims, 3 Drawing Sheets

SHORT ARC TYPE METAL HALIDE LAMP WITH ENCAPSULATED RARE EARTH METAL HALIDES TO INCREASE COLOR REPRODUCIBILITY

BACKGROUND OF THE INVENTION

1. Field of the Invention

The invention relates to a metal halide lamp of the short arc type which is used as a light source of an overhead projector (OHP), a direct projector, and the like.

2. Description of Related Art

Conventionally, an overhead projector is known as an information presentation tool. However, recently, a liquid crystal projector which projects a liquid crystal display, and a direct projector have become common; only by simply placing an article to be projected on a sample carrier can the direct projector project its color and shape as it is. Conventionally, halide lamps are used for light sources of these projection devices. However, recently, instead of halogen lamps, metal halide lamps of the short arc type have been used because in halogen lamps there are the disadvantages of more frequent bulb changing than in discharge lamps, low radiant efficiency, image brightness on the projection screen which is inadequate due to its yellowish, warm-color emission in a bright room, and the like.

In a metal halide lamp of the short arc type, a pair of electrodes disposed opposite one another within an arc tube at a distance of a few millimeters, encapsulated together with mercury as a buffer metal, a starting rare gas, and metal halides as emission metals. The metal halides melt during luminous operation and are present on the wall of the arc tube as a liquid, while they partially vaporize as a gas, and dissociate into metal atoms and halogen in the high temperature range of the arc center, the metal elements being excited by the arc and emitting spectra which are typical of the metals.

In a metal halide lamp, the metal halides vaporize in this way. Therefore, a vapor pressure is obtained to a sufficient degree at a temperature which is lower than in the metal elements. Furthermore, better radiant efficiency than in a high pressure mercury lamp, and in addition, good color reproduction can be obtained by means of suitable selection of the metals to be encapsulated,.

In the above described projection device, the liquid crystal projector in which a metal halide lamp is used as the light source has a red color filter, a green color filter and a blue color filter. By combining the light from the lamp with these color filters, good color reproducibility can be achieved on the screen surface. In an OHP or direct projector, however, the light does not pass from the metal halide lamp through the filter, but is projected directly. Therefore, here, there is a need for more exact color reproducibility than in a liquid crystal projector.

If, for example, a metal halide lamp which is often used for a light source of a liquid crystal projector and in which halides of dysprosium, neodymium and cesium are encapsulated as the emission halides is used for the light source of an OHP or direct projector, the proportion of green color to which an individual reacts sensitively increases in the image projected onto the screen, and the component of blue decreases, resulting in the disadvantage that sufficient color reproducibility cannot be obtained.

SUMMARY OF THE INVENTION

Therefore, a primary object of the invention is to devise a metal halide lamp in which the light output is not adversely affected, in which outstanding color reproducibility is obtained, and which is suitable for the light source of an OHP or a direct projector.

This object is achieved according to the invention by the fact that, in a metal halide lamp, within an arc tube provided with a pair of electrodes are encapsulated together with mercury, starting rare gas halides of dysprosium (Dy), yttrium (Y) and cesium (Cs) as the metal halides, and that the encapsulated metals of Dy to Y have a molar ratio that is set in accordance with the relationship $0.3 \leqq Dy/Y \leqq 1.0$.

By suitably establishing the encapsulation amounts of the halides of Dy and Cs, a light source with good radiant efficiency, good emission color characteristic, and good color reproduction can be obtained. But, the inventors have observed that Y is effective for increasing the color reproducibility, and have found that by encapsulation of Dy and Y in a stipulated ratio the green portion is reduced and the blue portion is intensified. Thus, when this metal halide lamp is used for a light source of an OHP or a direct projector, the color reproducibility is extremely good, and they have implemented this invention.

This means that when used for a light source of an OHP or a direct projector, the color reproducibility on the projection screen is increases as the value of the molar ratio of the encapsulated metals Dy to Y, i.e., the value of Dy/Y, decreases. On the other hand, there is also the tendency for the light yield to become less as the value of Dy/Y is reduced. Thus, it is necessary that Dy/Y be greater or equal to 0.3 in order to increase the color reproducibility and at the same time obtain a light yield which is sufficient for practical use. Furthermore, as the upper limit of Dy/Y, it is necessary that $Dy/Y \leqq 1.0$ in order to obtain color reproducibility which is good for practical use. Finally, by establishing the molar ratio of the encapsulated metals of Dy to Y in the range of $0.3 \leqq Dy/Y \leqq 1.0$, both outstanding color reproducibility and also a radiant efficiency which is sufficient for practical use is obtained.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
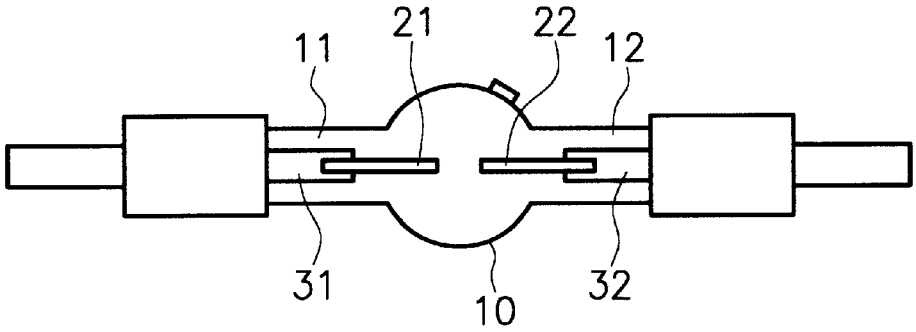
FIG. 1 shows an overhead view of a metal halide lamp.

FIG. 1 is a overhead view of a metal halide lamp of the short arc type which is operated using an alternating current and has an essentially spherical quartz glass arc tube 10 with, for example, a maximum inside diameter of 13 mm and an inner volume of 1.3 $cm^3$. Opposite sides of the arc tube 10 have hermetically sealed parts 11 and 12 within each of which a respective molybdenum foil 31, 32 is inserted; a respective one of a pair of opposed electrodes 21, 22 are connected to each of the foils. The distance between the tips of electrodes 21 and 22, i.e., the distance between the electrodes, is 6.0 mm. The invention can of course also be used for a metal halide lamp which is operated using a direct current.

Mercury as the buffer metal and argon gas as the starting rare gas are encapsulated within arc tube 10. Furthermore, iodides as the halides of Dy, Y and Cs are encapsulated as the necessary emission metals. Here, the molar ratio of encapsulated Dy to encapsulated Y is within the range from $0.3 \leqq Dy/Y \leqq 1.0$.

Furthermore, besides the halides of Dy, Y and Cs, other emission metals are encapsulated when necessary. For example, at least one of the halides of holmium, erbium, gadolinium, thulium, cerium, praseodymium, neodymium and the like are encapsulated to improve color reproduction. In addition to the before-mentioned rare earth halides or independently thereof, for purposes of improving the color hue, at least one halide of lutetium or any other metal of the rare earths may be encapsulated. Furthermore, a mixture of iodide and bromide can be used as the halides.

A metal halide lamp of the short arc type has a high color temperature and good color reproduction. If it is used as the light source of an OHP or a direct projector, outstanding color reproducibility, and furthermore, a radiant efficiency sufficient for practical use can be obtained.

In the following, the results of studies in which the effects of changes of the molar ratio of the encapsulated Dy to the encapsulated Y on color reproducibility, radiant efficiency and color temperature are described.

First of all, a test was run with respect to color reproducibility based on the color reproduction evaluation index method. Here JIS-defined sample colors are used as reference light and based on their color difference which is ascertained for illumination by means of this reference light and for illumination by means of a sample light source, an evaluation index of color reproduction is computed based on the stipulated formula. The larger the evaluation index of color reproduction, the smaller the color difference between the reference light and the sample light source.

In this test, sample color No. 5, i.e., "dark blue-green", and sample color no. 7, i.e., "bright blue-violet" with stipulated spectra were used.

Figure 2:
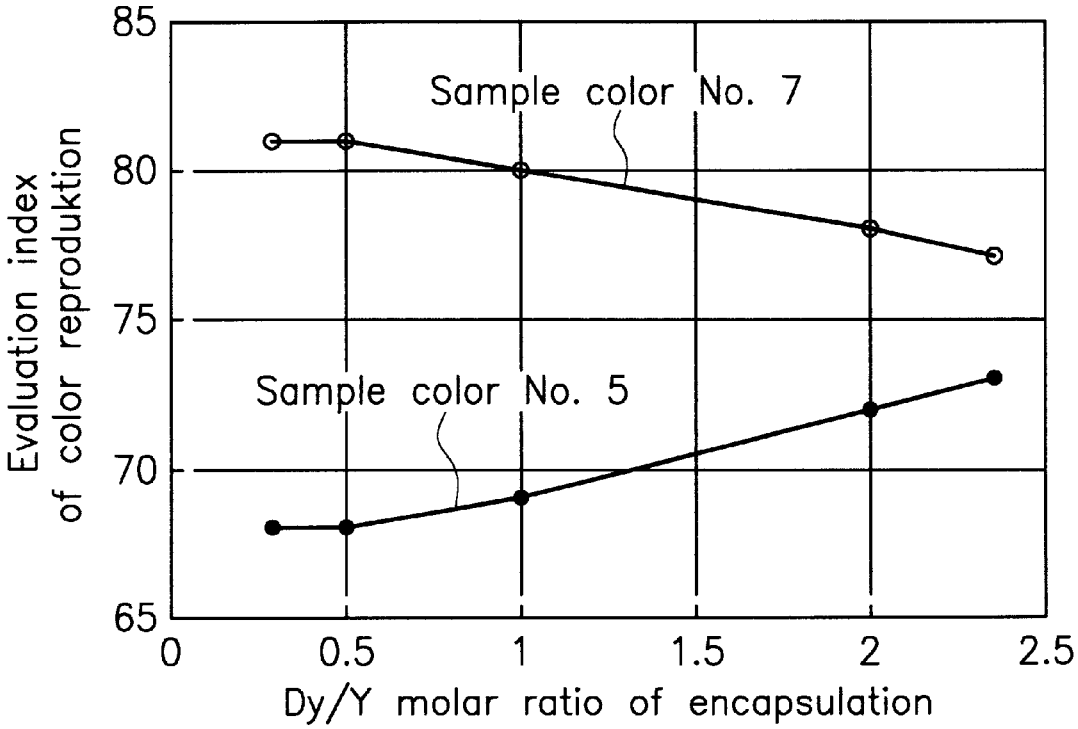
FIG. 2 is a graph showing the relation between the molar ratio of the encapsulated Dy to the encapsulated Y and the evaluation index of color reproduction.

The result is shown in FIG. 2. Here, the tendency is confirmed that the greater the value of Dy/Y, the greater becomes the evaluation index of color reproduction of sample color no. 5("dark blue-green") and the smaller becomes the evaluation index of color reproduction of sample color no. 7 ("bright blue-violet"). This means that here the tendency is confirmed that the greater the value of Dy/Y becomes, the stronger the green portion and the weaker the blue portion become. It was, furthermore, ascertained that the green portion, to which there is a sensitive visual reaction, is reduced, that the blue component is intensified, and that, in actual projection onto the projection screen, with the direct projector, the color reproducibility of the image is extremely good, when $Dy/Y \leqq 1.0$.

Figure 3:
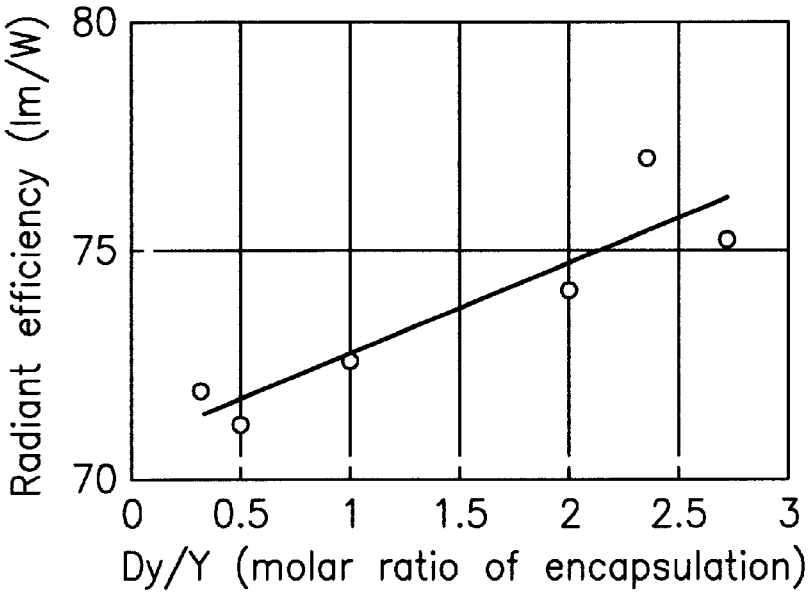
FIG. 3 is a graph showing the relation between the molar ratio of the encapsulated Dy to the encapsulated Y and the radiant efficiency.

FIG. 3 shows the relation between the radiant efficiency (1 m/W) and the value of Dy/Y. To obtain a light yield necessary for practical use of greater than 701 1 m/W it is necessary that $0.3 \leqq Dy/Y$. To obtain color reproducibility and radiant efficiency which are sufficient for practical use, it is therefore necessary that $0.3 \leqq Dy/Y \leqq 1.0$.

Figure 4:
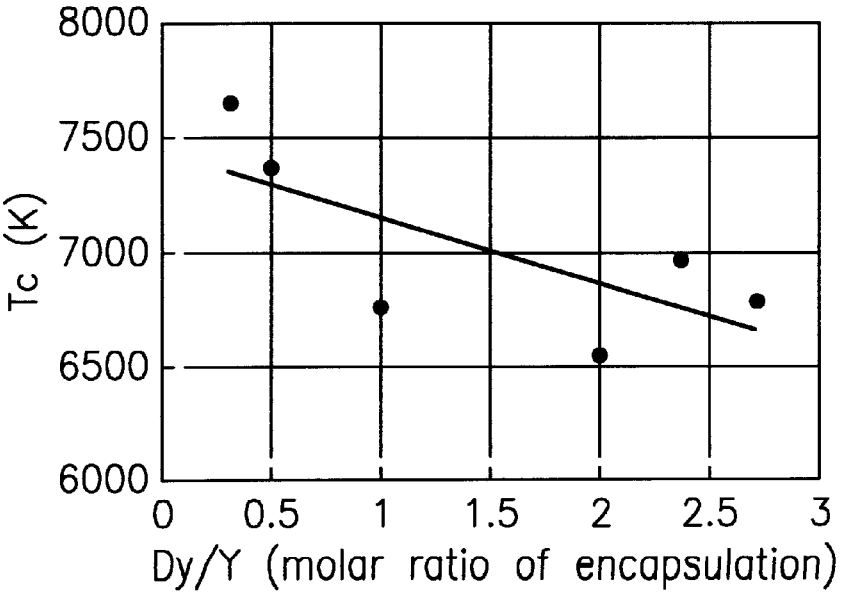
FIG. 4 is a graph showing the relation between the molar ratio of the encapsulated Dy to the encapsulated Y and the color temperature.

FIG. 4 shows the relation between the color temperature (K) and the value of Dy/Y. When $0.3 \leqq Dy/Y \leqq 1.0$ the color temperature is greater than or equal to 7000 K, and a color temperature sufficient for practical use can be obtained.

Figure 5:
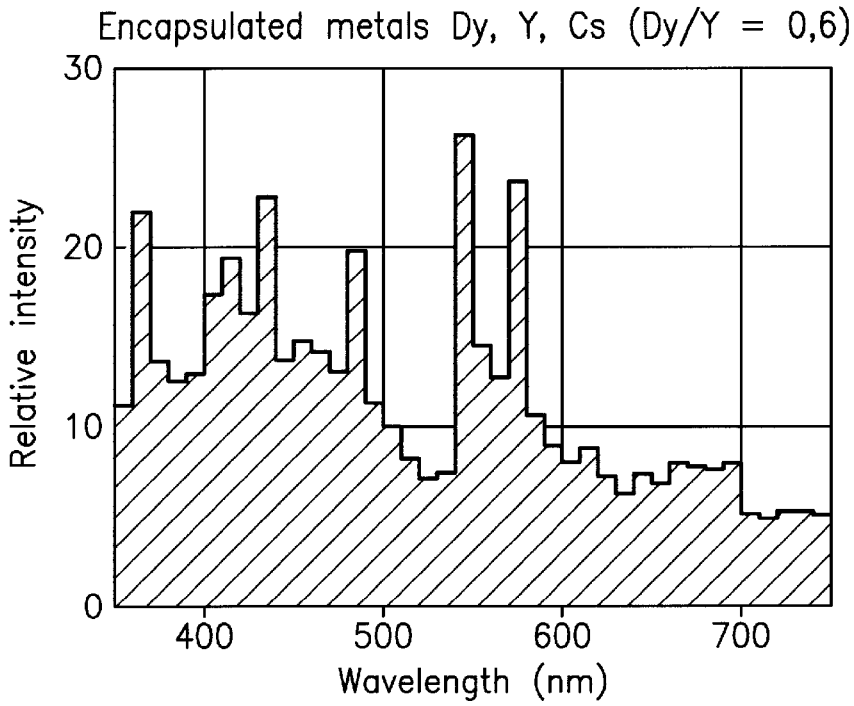
FIG. 5 is a graph of the spectra in the embodiment according to the invention.
Figure 6:
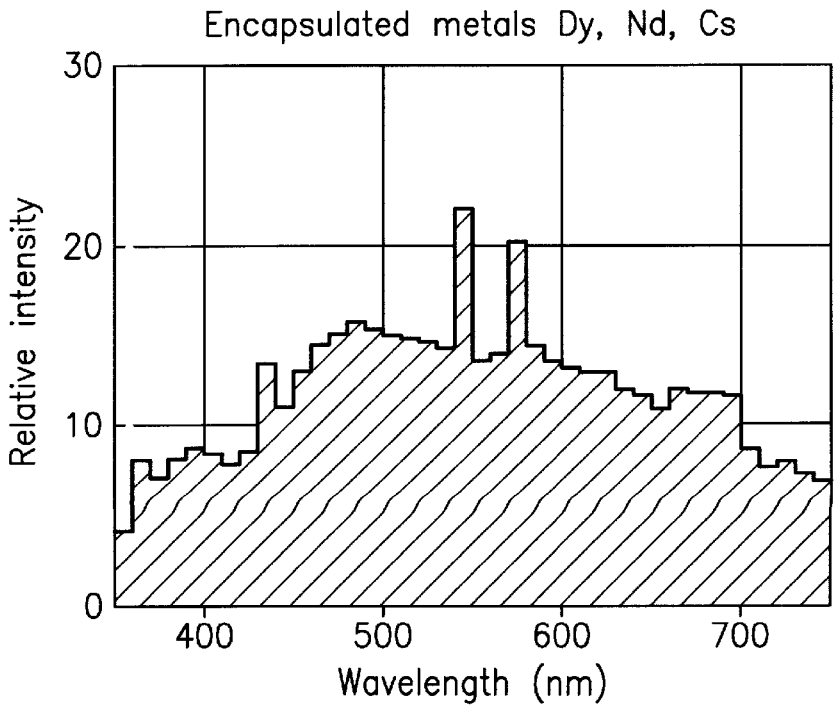
FIG.6 (Prior Art)
FIG. 6 is a graph of the spectra in a comparison example.

FIG. 5 shows the spectra of the metal halide lamp in the embodiment according to the invention, in which the encapsulated metals are Dy, Y, and Cs (Dy/Y=0.6). FIG. 6 shows the spectra of a metal halide lamp in a comparison example in which the encapsulated metals are Dy, Nd and Cs and in which Y is not encapsulated.

As this clearly shows, the metal halide lamp in the embodiment according to the invention has a smaller green portion with wavelengths from 500 to 550 nm and a larger blue portion with wavelengths from 450 to 500 nm compared to the metal halide lamps in the comparison example. It also is apparent from the spectra that color reproducibility is outstanding in the metal halide lamp according to the invention.

As was described above, in the metal halide lamp of the invention, by encapsulating Dy, Y and Cs as the necessary emission metals and by fixing the molar ratio of the encapsulated Dy to the encapsulated Y in the optimal range, a metal halide lamp is obtained in which there is no adverse effect on radiant efficiency and in which the color reproducibility on the projection screen is outstanding when used for the light source of an OHP or direct projector.

It is to be understood that although a preferred embodiment of the invention has been described, various other embodiments and variations may occur to those skilled in the art. Any such other embodiments and variations which fall within the scope and spirit of the present invention are intended to be covered by the following claims.

What we claim is:

1. Metal halide lamp comprising an arc tube with a pair of electrodes therein, said arc tube having mercury, a starting rare gas, and metal halides of dysprosium (Dy), yttrium (Y) and cesium (Cs) encapsulated therein; wherein said metal halides of dysprosium (Dy) and yttrium (Y) have a molar ratio of Dy to Y which is fixed in a range of $0.3 \leqq Dy/Y \leqq 1.0$.

2. Metal halide lamp according to claim 1, wherein said arc tube has at least one additional rare earth halide encapsulated therein.

3. Metal halide lamp according to claim 2, wherein said at least one additional rare earth halide is a halide selected from a group consisting of holmium, erbium, gadolinium, thulium, cerium, praseodymium or neodymium.

4. Metal halide lamp according to claim 3, wherein said arc tube further encapsulates a lutetium halide.

5. Metal halide lamp according to claim 2, wherein said at least one additional rare earth halide is a lutetium halide.

* * * * *